US007905484B2

(12) United States Patent
Komuro

(10) Patent No.: US 7,905,484 B2
(45) Date of Patent: Mar. 15, 2011

(54) SHEET FEEDING APPARATUS

(75) Inventor: Hiroshi Komuro, Wako (JP)

(73) Assignee: Canon Denshi Kabushiki Kaisha, Chichibu-shi (JP)

( * ) Notice: Subject to any disclaimer, the term of this patent is extended or adjusted under 35 U.S.C. 154(b) by 0 days.

(21) Appl. No.: 12/335,758

(22) Filed: Dec. 16, 2008

(65) Prior Publication Data

US 2009/0160119 A1 Jun. 25, 2009

(30) Foreign Application Priority Data

Dec. 20, 2007 (JP) ..... 2007-328764

(51) Int. Cl.
*B65H 7/12* (2006.01)

(52) U.S. Cl. ..... 271/263; 271/262; 271/265.04; 271/122; 271/124; 271/125; 271/10.03; 271/4.03

(58) Field of Classification Search ..... 271/122, 271/124, 125, 262, 263, 265.04, 10.03, 4.03
See application file for complete search history.

(56) References Cited

U.S. PATENT DOCUMENTS

| | | | | |
|---|---|---|---|---|
| 4,779,861 | A * | 10/1988 | Ozawa et al. | 271/119 |
| 4,978,114 | A * | 12/1990 | Holbrook | 271/35 |
| 5,026,043 | A | 6/1991 | Tanjo et al. | 271/121 |
| 5,203,846 | A * | 4/1993 | Kuhns et al. | 271/125 |
| 5,238,236 | A * | 8/1993 | Belec et al. | 271/34 |
| 6,109,522 | A * | 8/2000 | Force et al. | 235/379 |
| 6,168,146 | B1 | 1/2001 | Komuro et al. | 271/10.12 |
| 6,315,284 | B1 | 11/2001 | Komuro et al. | 271/127 |
| 7,140,607 | B2 * | 11/2006 | Graef et al. | 271/122 |
| 7,537,213 | B2 * | 5/2009 | Chang et al. | 271/262 |
| 2008/0073834 | A1 * | 3/2008 | Chang et al. | 271/262 |
| 2008/0284093 | A1 * | 11/2008 | Itoh et al. | 271/262 |

FOREIGN PATENT DOCUMENTS

| | | |
|---|---|---|
| JP | 2-147533 | 6/1990 |
| JP | 3-262064 | 11/1991 |

* cited by examiner

*Primary Examiner* — Stefanos Karmis
*Assistant Examiner* — Prasad V Gokhale
(74) *Attorney, Agent, or Firm* — Fitzpatrick, Cella, Harper & Scinto

(57) ABSTRACT

A sheet feeding apparatus capable of obtaining a sufficient conveying force for pulling back double-fed overlapping sheets to a stacking tray side. A sheet feeding member feeds sheets incoming from a stacking tray which stacks the sheets into a conveying pass. A separating member separates the sheets fed to the conveying pass by the sheet feeding member one by one. A double feed detection sensor generates an output for detecting double feed of sheets fed to the conveying pass. A rotatable member contacts the fed sheet. A driving unit rotationally drives at least the rotatable member in a rotational direction for reverse feeding of sheets. A control unit controls the driving unit when the double feed of sheets is detected based on the output of the double feed detection sensor, such that the rotatable member is rotationally driven in the rotational direction for reverse feeding of sheets.

8 Claims, 11 Drawing Sheets

SHEET FEEDING APPARATUS

BACKGROUND OF THE INVENTION

1. Field of the Invention

The present invention relates to a sheet feeding apparatus which is used for a scanner, facsimile, copier, or printer, for example, and feeds originals separating one by one.

2. Description of the Related Art

FIG. 10 is a view showing a scanner including a conventional sheet feeding apparatus.

The sheet feeding apparatus shown in FIG. 10 includes a pickup roller 102 that contacts the top surface of a batch of originals (sheets) stacked on a sheet supply tray 101 and feeds out the originals in a sheet feeding direction. The originals 100*a* picked up by the pickup roller 102 are separated one by one and fed to a conveying pass by a feed roller 104 and a retard roller 105.

A double feed detection sensor 107 that generates an output for detecting double feed of originals is disposed between the feed roller 104 and the retard roller 105, and a registration roller pair 115.

In the conventional sheet feeding apparatus, generally when the double feed of originals is detected by the double feed detection sensor 107, the operation in which the originals picked up by the pickup roller 102 are separated one by one and fed by the feed roller 104 and the retard roller 105 is stopped, and a warning of double feed occurrence is issued. An operator feeds the double-fed originals again by hand based on the warning or the like, to prevent missing of images.

Thus, if the double feed of originals occurs during an image reading process, the sheet feeding is stopped, and it is necessary for the operator to remove the double-fed originals, and confirm whether or not any other originals being read remain in the apparatus.

Also, since the scanner itself temporarily stops operating each time the double feed of originals occurs, the operating rate is inevitably reduced. Thus, the working efficiency significantly decreases especially when a large number of originals are processed.

In order to solve such a disadvantage, there has been proposed a scanner which temporarily stops the feeding operation of originals when the double feed of originals is detected, automatically pulls back the double-fed originals 100*a* toward the sheet supply tray 101, and performs the separating and feeding operation again.

In such a scanner, after the double feed of originals is detected, the feed roller 104 is rotated in a direction opposite to a normal rotational direction (hereinafter simply referred to as "feeding direction") to feed originals in the sheet feeding direction, and the retard roller 105 is rotated in a separating direction for separation of originals, so that the double-fed originals can be pulled back to the sheet supply tray 101 side.

A one-way clutch 501 is provided between the feed roller 104 and a driving unit, not shown, that drives the feed roller 104 in order to prevent the feed roller 104 from applying a load to conveyance while an original reaches a downstream convey roller to be conveyed.

Accordingly, even if the driving unit is reversely rotated for driving the feed roller 104 in the reverse direction, the driving torque is not transmitted via the one-way clutch 501 to the feed roller 104. Therefore only a conveying force transmitted from the retard roller 105 acts as a force to pull back the originals toward the sheet supply tray 101.

On the other hand, the retard roller 105 includes a torque transmitting member 502 such as a torque limiter or spring clutch for allowing a certain torque to act in the direction opposite to the feeding direction. The rotational driving force of a motor or the like is transmitted via the torque transmitting member 502.

Therefore, when the double-fed originals are pulled back to the sheet supply tray 101 side, the conveying force of the retard roller 105 may be limited by the slidable force of the torque limiter or spring clutch, and a sufficient reverse conveying force may not be obtained by the retard roller 105.

Accordingly, there has been proposed a technique in which a rotatable member having a protrusion is provided coaxially with the retard roller 105 and the rotatable member is rotationally driven in the direction opposite to the feeding direction, so that the protrusion pulls back the double-fed originals toward the sheet supply tray 101 (see Japanese Laid-Open Patent Publication (Kokai) No. 02-147533).

However, in this technique, the driving of the retard roller 105 and the driving of the rotatable member need to be separately controlled. In addition, since only the protrusion of the rotatable member contacts the originals, a sufficient reverse conveying force cannot be also obtained.

There has also been proposed a technique in which a feed roller 201 and a retard roller 202 are formed with comb-tooth-like shape grooves on the outer peripheral portions thereof, and are disposed such that the concave portions and convex portions of the feed roller 201 are facing respectively toward the convex portions and concave portions of the retard roller 202. And the feed roller 201 and the retard roller 202 are in non-contact with each other and overlap each other in perspective view of axial direction thereof as shown in FIGS. 11 and 12 (see Japanese Patent No. 3262064).

In this technique, the feed roller 201 is rotated in the feeding direction, and the retard roller 202 is rotated in the direction opposite to the feeding direction, so that the shaft of the feed roller 201 and the shaft of the retard roller 202 approach or move away from each other as shown in FIG. 12. The overlapping amount between the concave portions and convex portions is thereby changed, and the originals picked up by the pickup roller 102 in the feeding direction are separated one by one and fed.

In this case, the retard roller 202 is constantly rotated in a separating direction to pull back the originals oppositely from the feeding direction during the separating and feeding operation, and a rotational torque for rotating the retard roller 202 in the direction opposite to the feeding direction can be sufficiently ensured. However, in the case of such a configuration, a sufficient feeding force for originals cannot be obtained since the comb-tooth-like feed roller 201 and the comb-tooth-like retard roller 202 are in non-contact with each other as described above. Thus, the pickup roller 102 supplements the feeding force for originals separated and fed by the feed roller 201 and the retard roller 202.

On the other hand, when the double-fed originals are conveyed in a reverse direction to pull back the originals toward the sheet supply tray 101 by the feed roller 201 and the retard roller 202 after detecting the double feed of originals, a sufficient reverse conveying force cannot be obtained since the pickup roller 102 is retracted.

Also, there has been proposed a technique in which a feed roller 104 and a separating pad member 301 are used to separate and feed originals as shown in FIG. 13.

In this technique, even when the feed roller 104 is to be reversely rotated for pulling back the originals toward the sheet supply tray 101 after detecting the double feed of originals, the feed roller 104 cannot be reversely rotated since a one-way clutch or the like is incorporated in the feed roller 104 in most cases.

Also, an envelope-shaped original or an original with a sticky note being attached thereto may be read by an image reading unit 116.

When double feed detection is performed with respect to the original having an overlapping portion as described above by using the double feed detection sensor 107 that is singly provided on the conveying pass as shown in FIG. 14, double feed is detected even when the original is normally conveyed. Therefore, at the time of conveying the original with a sticky note being attached thereto, for example, it is necessary to stop detection of the double feed of originals in a position where the sticky note is attached.

In order to solve this problem, an apparatus having a plurality of double feed detection sensors 107 disposed in the width direction of the conveying pass has been proposed as shown in FIG. 15.

In such an apparatus, an area in which the double feed is detected is set in advance, and the plurality of double feed detection sensors 107 are disposed in the width direction of the conveying pass. Accordingly, even if the sticky note is attached to the original, the detection of double feed of originals is stopped in the position where the sticky note is attached.

Also, the double feed of originals can be detected in a plurality of positions where the double feed detection sensors 107 are arranged. Therefore, even when originals having difference sizes are mixedly stacked on the sheet supply tray 101, the double feed of originals can be detected.

For example, as shown in FIG. 15, in a case where an small size original 100*a* slips into large size originals 100*b* and the originals are double-fed with the small original 100*a* being decentered to one side, the double feed can be detected. Missing of images or a paper jam can be thereby prevented.

However, in the case of such double feed of originals, at the time of pulling back the double-fed originals toward the sheet supply tray 101 by the feed roller 104 and the retard roller 105 after detecting the double feed of originals, the feed roller 104 and the retard roller 105 may not contact the double-fed small original.

If the operation of pulling back the originals is performed in such a state, the small original on the large original is taken by the large original to be pulled back toward the sheet supply tray 101 when the large original in contact with the feed roller 104 and the retard roller 105 is pulled back toward the sheet supply tray 101.

In this case, if the small original is prevented from moving toward the sheet supply tray 101 by contact with a conveying guide or the like, the small original is possibly left on the conveying pass. If the sheet feeding is resumed in this state, a paper jam or original breakage may be caused.

SUMMARY OF THE INVENTION

The present invention has been made to solve the disadvantages as described above, and provides a sheet feeding apparatus capable of obtaining a sufficient conveying force for pulling back double-fed overlapping sheets toward a stacking tray.

Accordingly, the present invention provides a sheet feeding apparatus comprising a stacking tray adapted to stack sheets, a sheet feeding member adapted to feed the sheets incoming from the stacking tray into a conveying pass, a separating member adapted to be disposed opposite to the sheet feeding member across the conveying pass and separate the sheets fed to the conveying pass by the sheet feeding member one by one, a double feed detection sensor adapted to generate an output for detecting double feed of sheets fed to the conveying pass, a rotatable member adapted to be disposed at a position close to the sheet feeding member in a sheet feeding direction and contact the fed sheet, a driving unit adapted to rotationally drive the rotatable member in a rotational direction for reverse feeding of sheets, and a control unit adapted to control at least the driving unit such that the rotatable member is rotationally driven in the rotational direction for reverse feeding of sheets when the double feed of sheets is detected based on the output of the double feed detection sensor.

According to the present invention, the sheet feeding apparatus capable of obtaining a sufficient conveying force for pulling back double-fed overlapping sheets toward a stacking tray can be provided.

The features and advantages of the invention will become more apparent from the following detailed description taken in conjunction with the accompanying drawings.

DETAILED DESCRIPTION OF THE PREFERRED EMBODIMENTS

Figure 1:
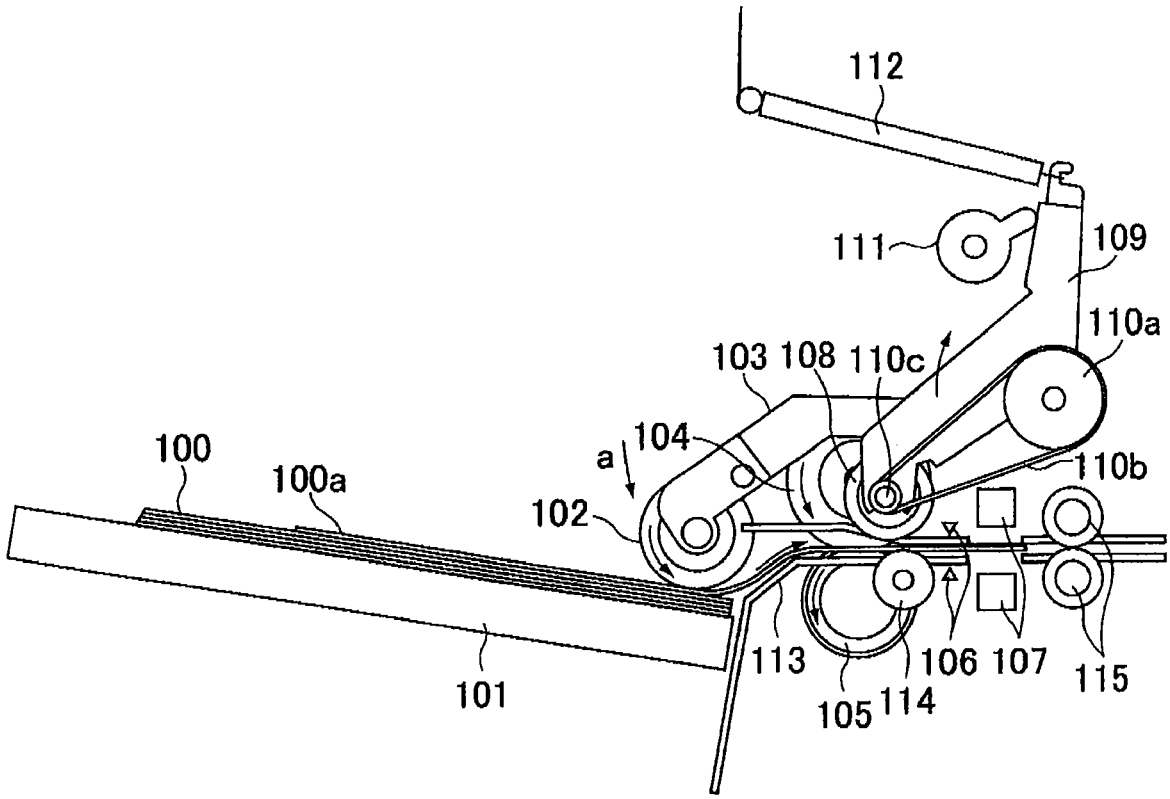
FIG. 1 is a sectional view for explaining a sheet feeding apparatus according to a first embodiment of the present invention.
Figure 2:
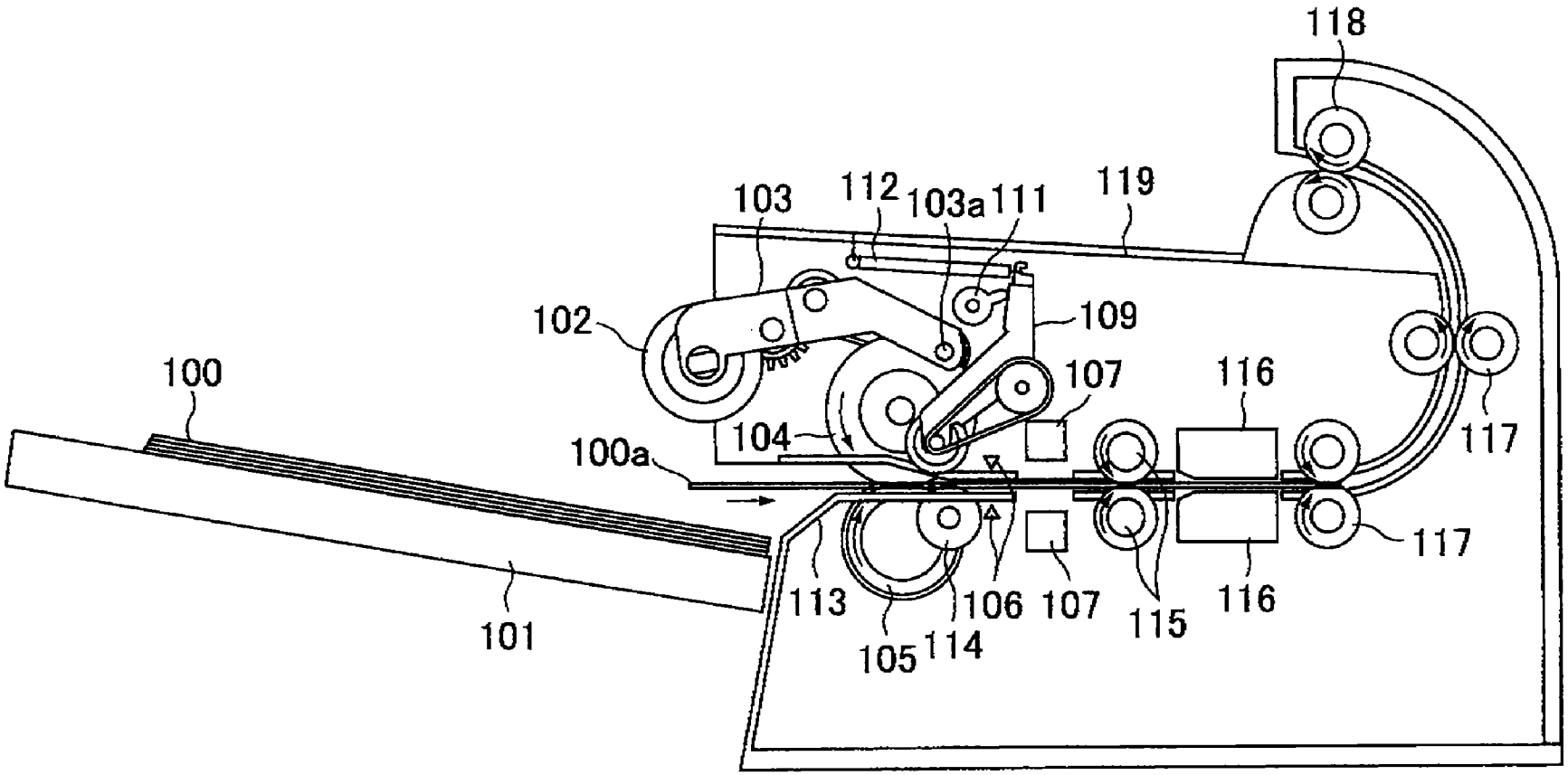
FIG. 2 is a sectional view for explaining a scanner including the sheet feeding apparatus in FIG. 1.

FIG. 1 is a sectional view for explaining a sheet feeding apparatus according to a first embodiment of the present invention. FIG. 2 is a sectional view for explaining a scanner including the sheet feeding apparatus in FIG. 1.

As shown in FIGS. 1 and 2, the sheet feeding apparatus in the present embodiment includes a sheet supply tray (stacking tray) 101, a pickup roller 102, a feed roller (feed member) 104, a retard roller (separation member) 105, a double feed detection sensor 107, and a pullback roller (rotatable member) 108.

The pickup roller 102 contacts the top surface of a batch of originals (sheets) 100 stacked on the sheet supply tray 101 to feed out originals 100*a* in a sheet feeding direction. The pickup roller 102 is rotatably supported on a swing arm 103. The swing arm 103 is swingably supported by a supporting shaft 103*a*.

The originals 100*a* fed out by the pickup roller 102 are separated one by one and fed to a conveying pass by the feed roller 104 and the retard roller 105. Conveying guides 113 that restrain the orientation of originals being conveyed on the conveying pass and guide the originals along the conveying pass are disposed on and under the conveying pass.

The double feed detection sensor 107 that generates an output for detecting double feed of originals is disposed between a separating feeding roller pair composed of the feed roller 104 and the retard roller 105, and a registration roller pair 115.

An optical double feed detection sensor such as a transmissive optical sensor, which allows detection of double feed based on a difference between transmitted light intensity in the case of a single original and transmitted light intensity in the case of overlapped originals, is known as the double feed detection sensor 107. An ultrasonic double feed detection sensor, in which an ultrasonic wave generator and a receiver are disposed with the conveying pass of originals being sandwiched therebetween, is also known as the double feed detection sensor 107. By using the ultrasonic double feed detection sensor, double feed can be detected when attenuation of ultrasonic waves becomes larger than normal attenuation of ultrasonic waves with which feeding a single original is detected.

A registration sensor 106 is disposed between the feed roller 104 and the retard roller 105, and the double feed detection sensor 107. Based on a detection signal of an original by the registration sensor 106, a control unit, not shown, determines the sheet feed timing of the next original or the like.

A pair of pullback rollers 108 driven at least one rotational direction for pulling back originals in a reverse feeding direction is disposed at substantially symmetrical positions outside of both end sides of the feed roller 104 in the axial direction of the feed roller 104 (in the sheet width direction vertical to the sheet feeding direction).

Figure 5:
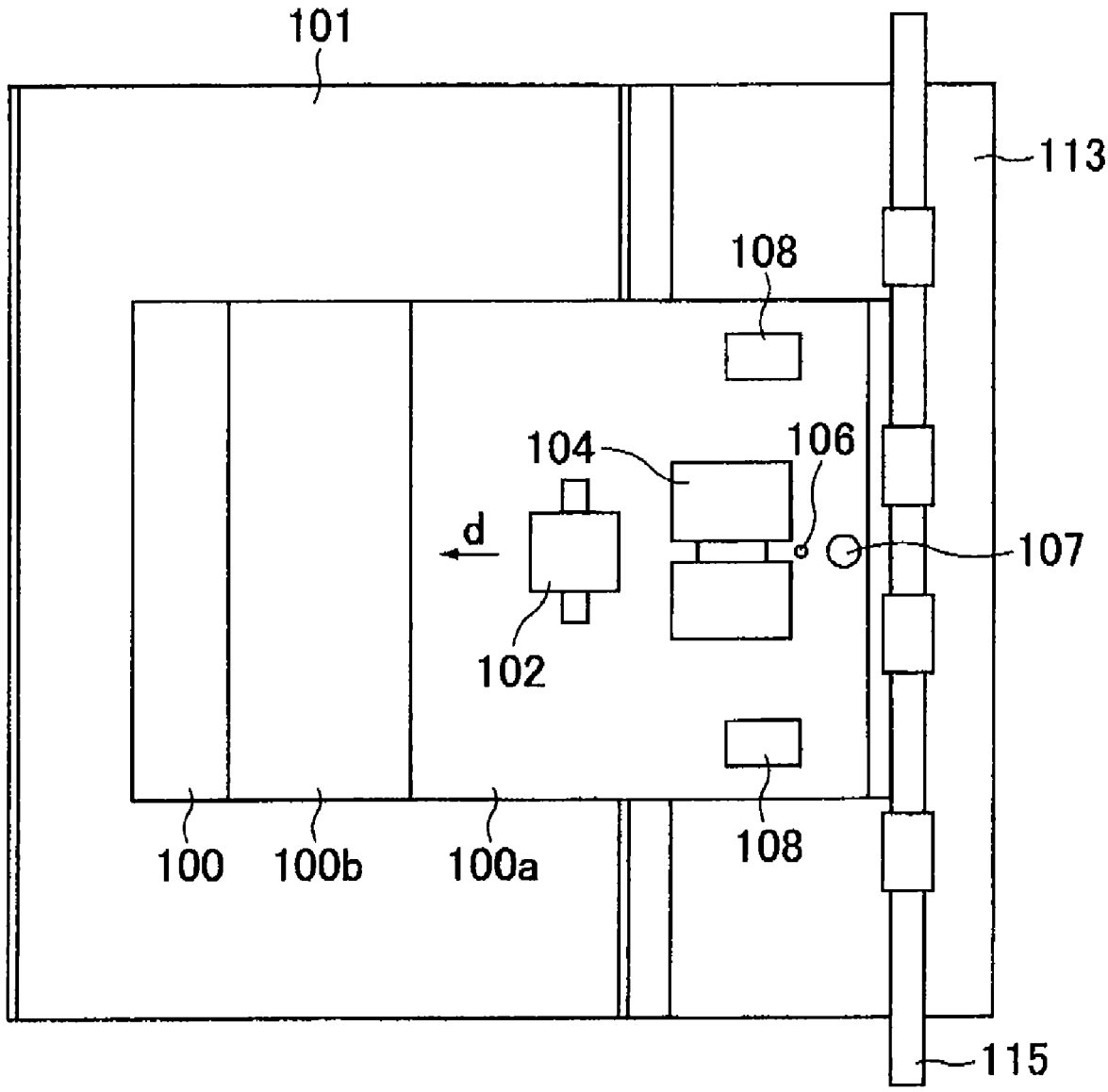
FIG. 5 is a plan view for explaining an operation of pulling back double-fed overlapping originals to a sheet supply tray side.

The pair of pullback rollers 108 is disposed at positions close to the feed roller 104 in the sheet feeding direction, that is, at substantially the same positions as the axis line of the feed roller 104 so as to overlap the feed roller 104 as seen from the axial direction as shown in FIG. 5. It is preferable to reliably pull back originals to the position upstream from the separating feeding roller pair by disposing the pair of pullback rollers 108 not at the positions shown in FIG. 5 but at positions where the axis line of the pair of pullback rollers 108 is located upstream from the axis line of the feed roller 104 on the conveying pass.

Also, each of the pair of pullback rollers 108 is rotatably supported on each arm 109 via a supporting shaft, not shown. The arm 109 is disposed so as to be able to displace the pullback roller 108 to a contact position where the pullback roller 108 contacts an original and to a retracted position where the pullback roller 108 does not contact an original, and displacement of the pullback roller is made in accordance with the state of a fed original.

A driven pulley 110*a* that is driven by a driving unit, not shown, is attached to the arm 109. The rotational driving force of the driven pulley 110*a* is transmitted to an idler pulley 110*c* attached to the pullback roller 108 via a timing belt 110*b*. Accordingly, the pullback roller 108 is rotationally driven in a direction opposite to the feeding direction.

Also, the arm 109 swings by a cam action of a rotating lever 111 in a state where the pullback roller 108 is urged by a tension coil spring 112 to displace the pullback roller 108 in such direction being able to make contact with an original with a certain pressing force, so that the pullback roller 108 is displaced to the contact position in contact with an original and to the retracted position.

That is, the arm 109 is in cam engagement with the rotating lever 111 to locate the pullback roller 108 in the position where the pullback roller 108 is retracted from a fed original when originals are in condition being normally separated and fed.

Figure 3:
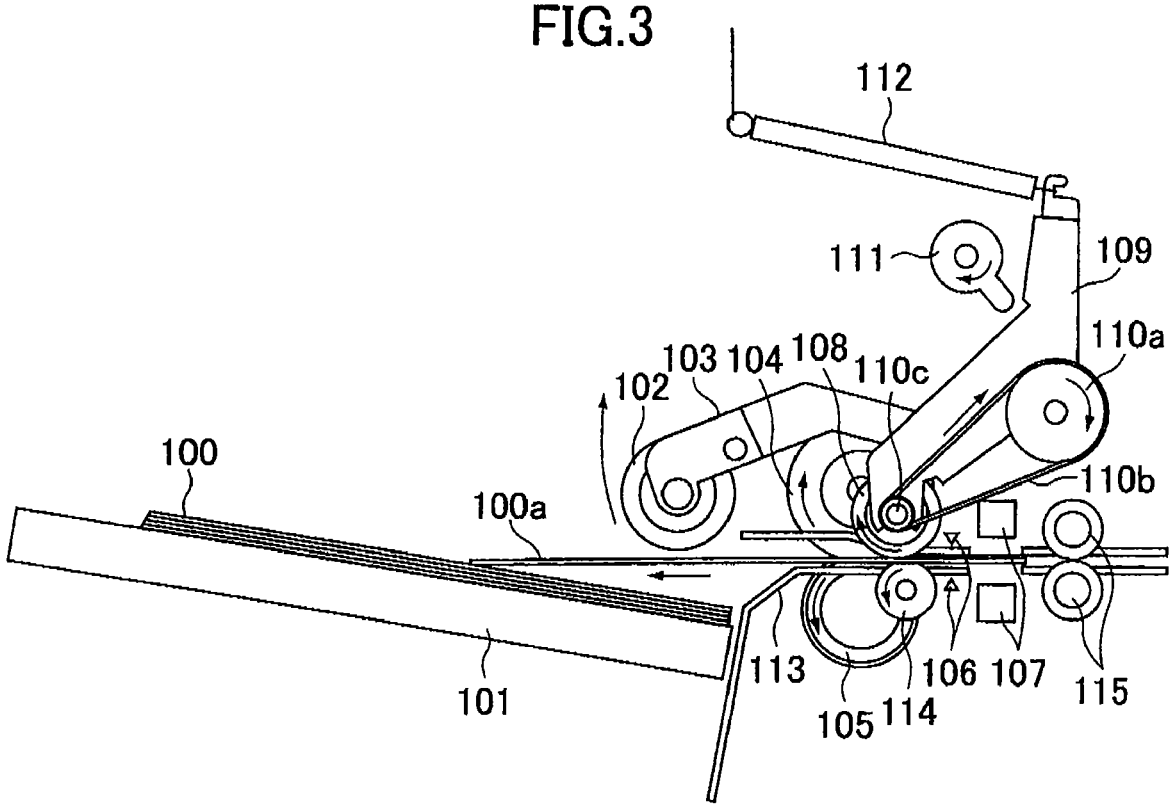
FIG. 3 is a sectional view for explaining a state in which a pullback roller presses and contacts a fed original with a certain pressing force.

When the rotating lever 111 is rotated in this state to release the cam engagement between the rotating lever 111 and the arm 109, the arm 109 swings to the contact position where the pullback roller 108 contacts the fed original while pressing the original with a certain pressing force due to the tension of the tension coil spring 112 (see FIG. 3). A control unit, not shown, controls the rotation of the rotating lever 111 and controls the driving unit of the driven pulley 110*a*.

A pullback idler roller 114 is disposed at a position opposite to the pullback roller 108 across the conveying pass. The pullback idler roller 114 is rotatably supported on the conveying guide 113. An image reading unit 116 for reading the images of originals being conveyed on the conveying pass performing photoelectric conversion and for acquiring image data is disposed in a position downstream from the registration roller pair 115. The original whose image is read by the image reading unit 116 is discharged to a discharge tray 119 via a convey roller pair 117 and a discharge roller pair 118.

Next, an example of a sequence of operations of the scanner having the above configuration will be described. It should be noted that when a control program stored in a memory unit not shown (ROM or hard disk or the like), is loaded into a RAM (not shown), and is executed, control bringing the sequence of operations to be described hereinafter into practice is performed by a control unit (CPU or the like), not shown.

First, when an image read command is input from an external apparatus, not shown, such as a PC, the control unit controls a driving source, not shown, of the rotating lever 111 engaging with the swing arm 103 and of the pickup roller 102 to displace the pickup roller 102 in the direction of an arrow "a" in FIG. 1 and rotate the pickup roller 102. The pickup roller 102 thereby contacts the top surface of the batch of originals 100 stacked on the sheet supply tray 101, and starts the operation of feeding out the originals.

The originals fed out by the pickup roller 102 are separated one by one and fed to the conveying pass by the feed roller 104 and the retard roller 105 driven by the control of the control unit.

Here, the drive shaft of the feed roller 104 and the feed roller 104 are coupled to each other via an one-way clutch, not shown. When the convey speed of the original conveyed by the registration roller pair 115 is faster than the feed speed of the original by the feed roller 104, the rotation of the feed roller 104 is synchronized with the movement of the conveyed original.

Also, the retard roller 105 is driven in the direction opposite to the feeding direction via a torque limiting member, not shown. However, when a torque exceeding a torque that can be transmitted by the torque limiting member acts on the retard roller 105 from the feed roller or the original being fed, the retard roller 105 is rotated in the feeding direction in synchronization with the movement of the feed roller or the movement of the original being fed.

In this state, the control unit controls the rotational position of the rotating lever 111 such that the rotating lever 111 is in cam engagement with the arm 109, and the pullback roller 108 is retracted to a position where the outer peripheral portion thereof is located on substantially the same face as the upper conveying guide 113 as shown in FIG. 1.

If the pullback roller 108 is retracted to a position where the outer peripheral portion thereof is above the conveying guide 113, the original is possibly caught in a hole in the conveying guide 113 at a position corresponding to the pullback roller 108. Thus, it is necessary to cover the hole with another member after the pullback roller 108 is retracted. In this case, the number of component parts is increased and the structure becomes complicated, so that the cost is increased.

On the other hand, if the original contacts the pullback roller 108 retracted to the retracted position, which is composed of a material having a high coefficient of friction such as rubber that is suitable for conveying the original, a large load preventing travel of original is applied to the original, to cause original skew and paper jam.

Therefore, it is preferable to provide the pullback roller 108 with a function of guiding the conveyance of originals through retracting the pullback roller 108 to the position of the conveying guide 113 and rotating the pullback roller 108 in the normal feeding direction and at the same peripheral speed as the feed roller 104 while the normal feeding operation of originals is being performed.

Subsequently, when the original separated and fed to the convey pass is conveyed to the registration sensor 106, the control unit controls the driving of relevant driving source, not shown, based on the detection signal of the original by the registration sensor 106 to move the swing arm 103 such that the pickup roller 102 is retracted from the originals. Accordingly, the feeding of the next original is not performed.

The control unit then determines whether or not double feed of the original is emerging based on a detection signal from the double feed detection sensor 107. When the control unit determines that the original is not being double-fed, the control unit continues to convey the original. After the original reaches the registration roller pair 115, the original is conveyed to the image reading unit 116 at constant speed and the image of the original is read by the image reading unit 116.

The original passing through the image reading unit 116 is discharged to the discharge tray 119 by the convey roller pair 117 and the discharge roller pair 118. By performing the above operations with respect to each original, all the images of the originals stacked on the sheet supply tray 101 are read by the image reading unit 116.

On the other hand, when the control unit determines that the originals are being double-fed based on the detection signal from the double feed detection sensor 107, the control unit controls relevant driving sources of the respective rollers 104 and 105 to temporarily stop the separating and feeding operation of originals by the feed roller 104 and the retard roller 105.

At this time, double-fed overlapping originals are stopped on the conveying pass, and the originals fed to the conveying pass before then are discharged to the discharge tray 119 via the convey roller pair 117 and the discharge roller pair 118 after the images of the originals are read by the image reading unit 116.

Subsequently, the control unit controls the rotational position of the rotating lever 111 such that the cam engagement between the rotating lever 111 and the arm 109 is released. The arm 109 thereby rotates in the counterclockwise direction in FIG. 3 due to the tension of the tension coil spring 112, so that the pullback roller 108 contacts and presses the plurality of double-fed originals with a certain pressing force with the originals being held between the pullback roller 108 and the pullback idler roller 114.

Figure 4:
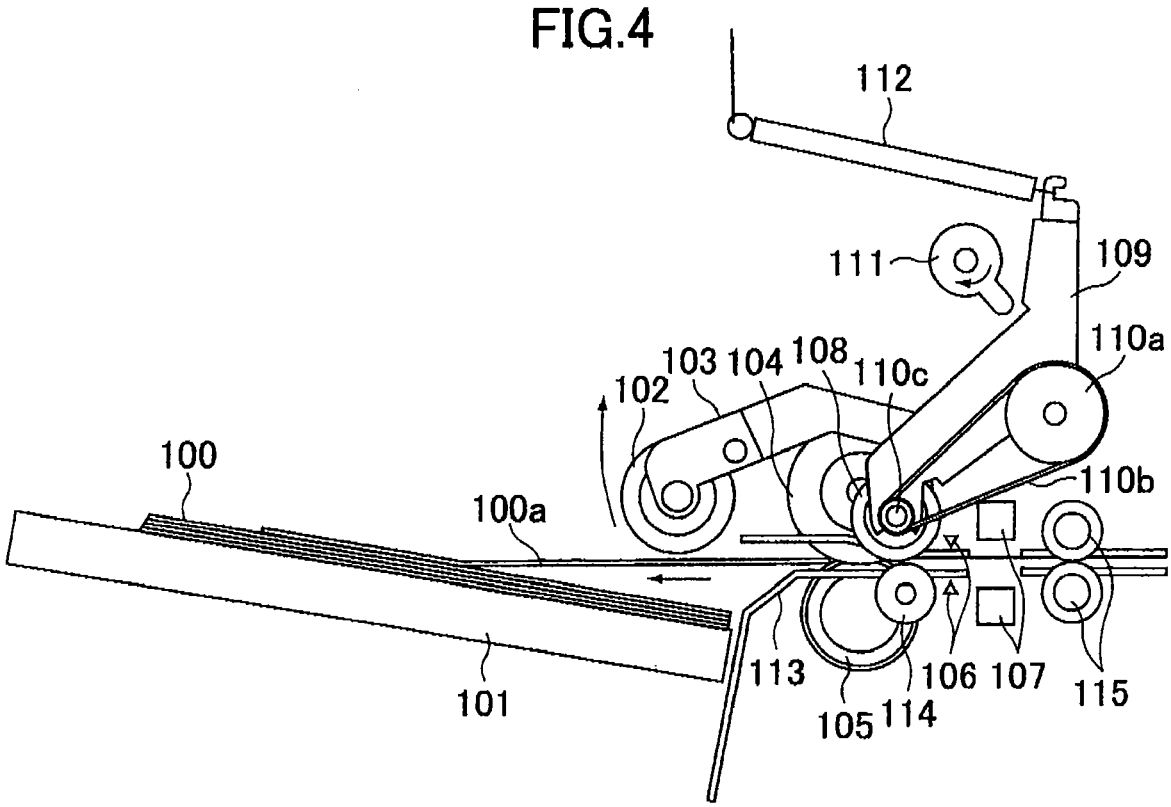
FIG. 4 is a sectional view for explaining a state in which double-fed overlapping originals are pulled back to a sheet supply tray side.

Then, the control unit controls relevant driving sources of the feed roller 104, the retard roller 105, and the pullback roller 108 such that the double-fed overlapping originals are pulled back to a position shown in FIG. 4 on the side of the sheet supply tray 101 (the direction of an arrow d in FIG. 5). The respective rollers 104, 105 and 108 are thereby rotated in the direction opposite to the feeding direction. Accordingly, a sufficient conveying force for pulling back the double-fed overlapping originals to the sheet supply tray 101 side can be obtained.

At this time, the double-fed originals are pulled back with the plurality of originals overlapping together to pass through the double feed detection sensor 107 or the registration sensor 106, and then, the double-fed originals are conveyed reversely during a predetermined time period or a predetermined rotation amount of a drive motor of the pullback roller 108 and stopped, for example.

After pulling back the double-fed overlapping originals to the feed supply tray 101, the control unit controls the rotational position of the rotating lever 111 such that the rotating lever 111 moves the arm 109 by cam drive. The outer peripheral portion of the pullback roller 108 is thereby retracted to the position on substantially the same face as the upper conveying guide 113.

The control unit controls relevant driving sources of the pickup roller 102, the feed roller 104, the retard roller 105 or the like to perform again the above operation of separating and feeding the overlapping originals pulled back to the sheet supply tray 101 to the conveying pass.

In the present embodiment, the operation of pulling back the double-fed overlapping originals to the sheet supply tray 101 and the subsequent separating and feeding operation of the originals are repeatedly performed up to a predetermined number of times (for example, the number of times that is set in advance).

In a case where the double feed of originals is detected based on the detection signal of the double feed detection sensor 107 even after exceeding the upper-limit number of times, the control unit performs control such that the double-fed originals are conveyed to the discharge roller pair 118 with the plurality of originals overlapping together and are stopped with the originals being held by the discharge roller pair 118. Accordingly, an operator can be reliably informed which original is double-fed, so that the operator can be prompted to pull out and to reload the double-fed originals to the sheet supply tray 101 by hand.

As described above, in the present embodiment, when the double feed of originals occurs, the double-fed overlapping originals are automatically pulled back to the sheet supply tray 101 side, to separate and feed the originals again. Accordingly, it is possible to prevent missing of image data caused by the double feed of originals. Also, since the pullback rollers 108 are provided at appropriate positions, troubles such as original breakage caused when the double-fed overlapping originals cannot be pulled back to the sheet supply tray 101 side can be reliably prevented, so that the processing capacity of originals can be improved.

Also, the pair of pullback rollers 108 is disposed at the substantially symmetrical positions in the axial direction on the both end sides of the feed roller 104. Therefore, even when originals having a narrow width are decentered to one side and double-fed, the originals can be reliably pulled back to the sheet supply tray 101 side.

Next, a sheet feeding apparatus according to a second embodiment of the present invention will be described with reference to FIG. 6. Portions overlapping those of the aforementioned first embodiment are assigned the same reference numerals in FIG. 6 to omit the description. Also, since a feed roller 201 and a retard roller 202 described using FIGS. 11 and 12 are used in the present embodiment, the description will be made using FIGS. 11 and 12.

Figure 11:
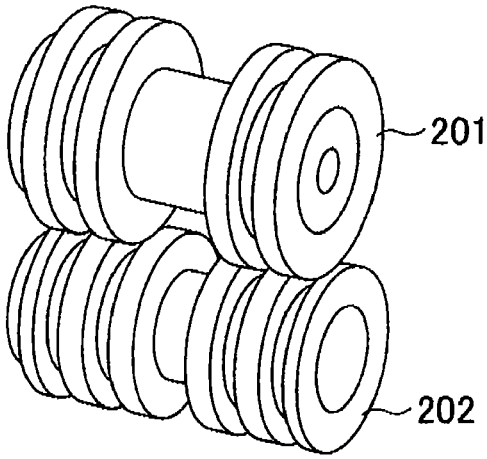
FIG. 11 is a perspective view for explaining a conventional feed roller and retard roller formed with comb-tooth-like shape grooves on the outer peripheral portions thereof.

In the sheet feeding apparatus of the present embodiment, the feed roller 201 and the retard roller 202 are formed with comb-tooth-like shape grooves as shown in FIG. 11 on the outer peripheral portions thereof, and are disposed such that the concave potions and convex portions of the feed roller 201 are facing respectively toward the convex portions and concave portions of the retard roller 202. And the feed roller 201 and the retard roller 202 are in non-contact with each other and overlap each other in perspective view of axial direction thereof. The feed roller 201 is rotationally driven in the feeding direction and the retard roller 202 is rotationally driven in the separating direction opposite to the feeding direction by relevant driving source(s), not shown. Also, a moving mechanism, not shown, performs control such that the shaft of the feed roller 201 and the shaft of the retard roller 202 come close to each other or move away from each other.

Figure 12:
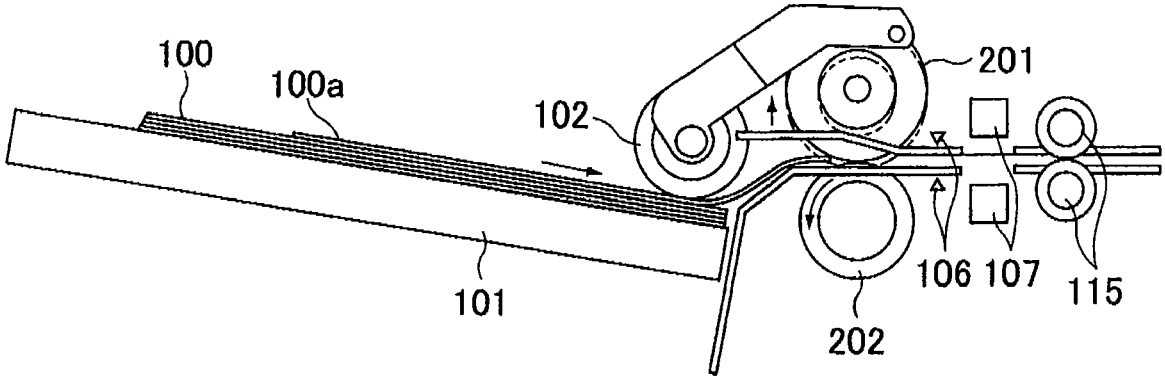
FIG. 12 is a sectional view for explaining a sheet feeding apparatus including the conventional feed roller and retard roller shown in FIG. 11.
Figure 13:
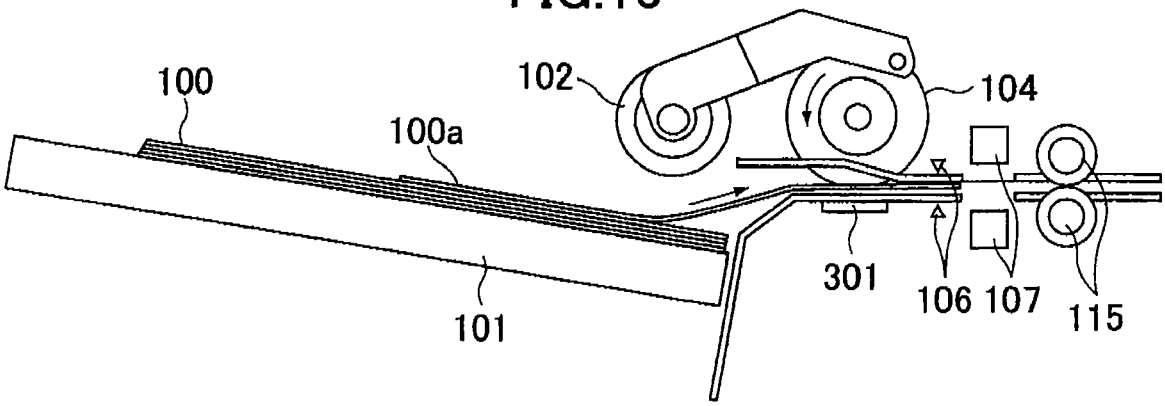
FIG. 13 is a sectional view for explaining a conventional sheet feeding apparatus including a feed roller and a separating pad member.
Figure 14:
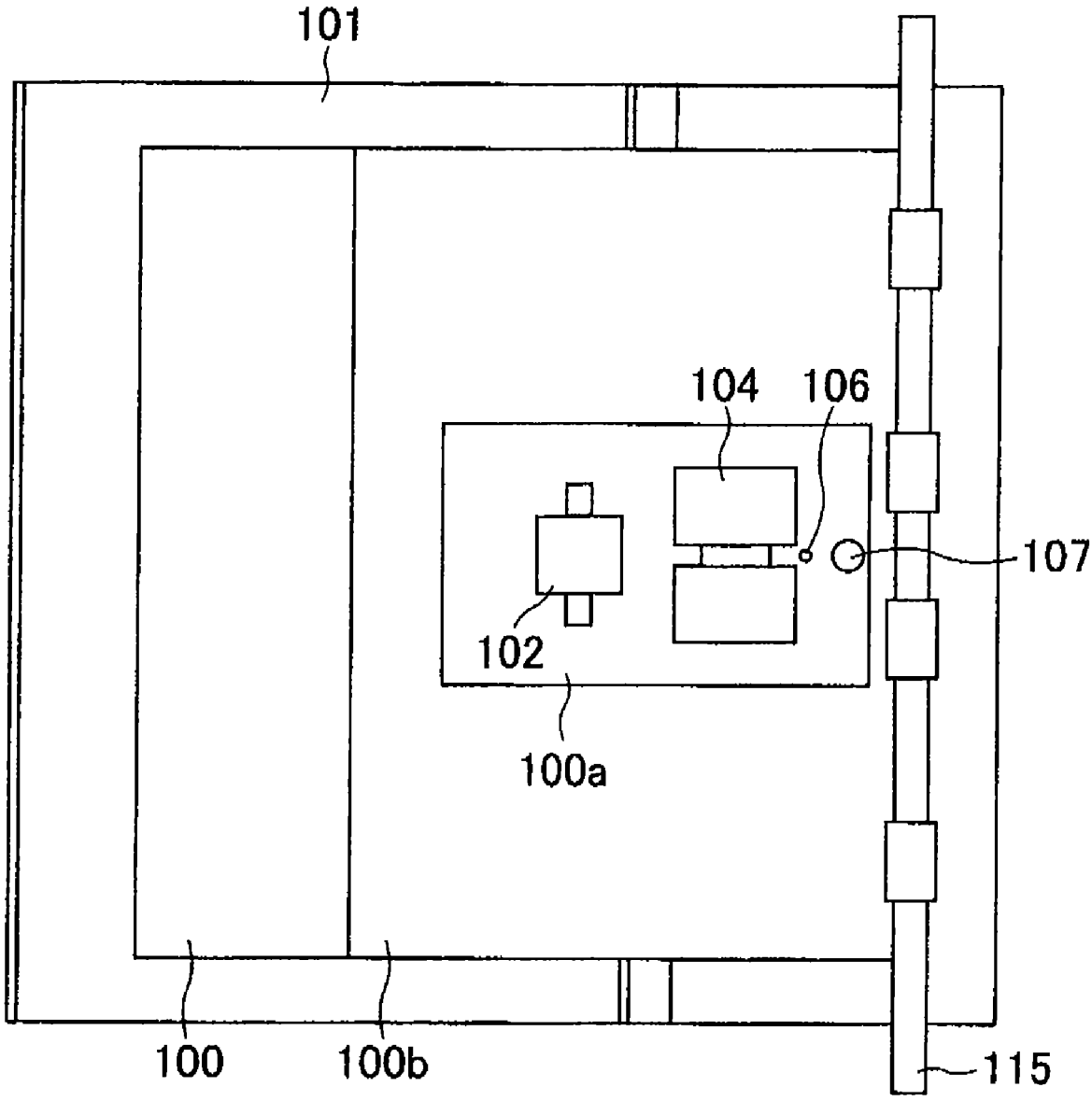
FIG. 14 is a plan view for explaining a conventional sheet feeding apparatus in which a double feed detection sensor is disposed at a central position in the width direction of a conveying pass.
Figure 15:
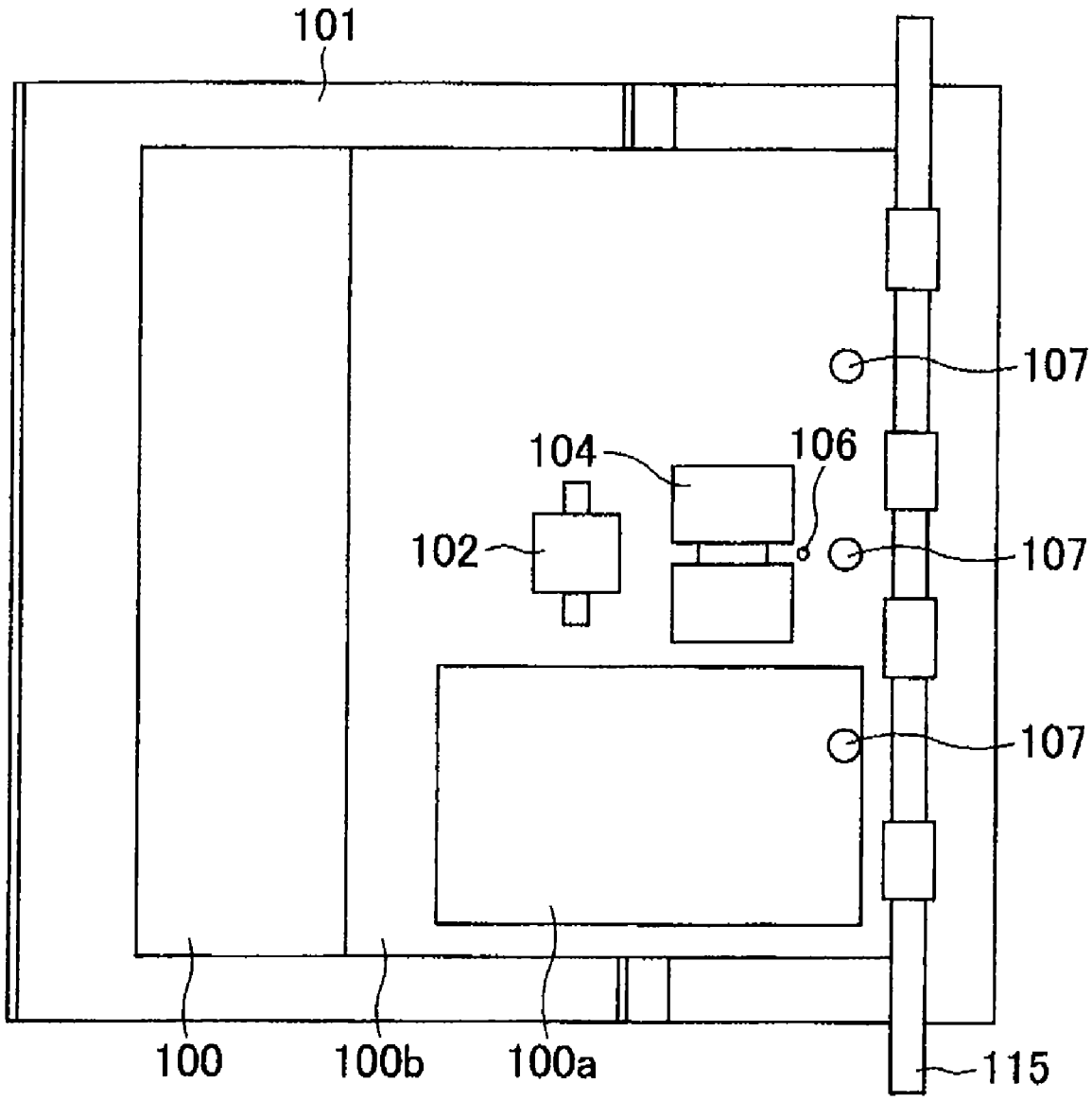
FIG. 15 is a plan view for explaining a conventional sheet feeding apparatus in which a plurality of double feed detection sensors are disposed in the width direction of a conveying pass.

As shown in FIG. 12, each original stacked on the sheet supply tray 101 is fed out in the sheet feeding direction by the pickup roller 102 in a similar manner to the aforementioned first embodiment.

Here, the control unit controls the moving mechanism, not shown, to adjust an inter-shaft distance between the feed roller 201 and the retard roller 202, and moves the feed roller 201. The inter-shaft distance between the feed roller 201 and the retard roller 202 thereby becomes a distance suitable for a single original to pass therethrough.

When the control unit detects that the original passes through between the rollers 201 and 202 by using the registration sensor 106 or the like, the control unit stops the operation of adjusting the inter-shaft distance and fixes the inter-shaft distance at the point in time.

Subsequently, when the control unit determines that the original is not being double-fed based on the detection signal from the double feed detection sensor 107, the control unit controls the pickup roller 102 to supplement the feeding force for the original, and controls conveying of the original to the registration roller pair 115.

By performing the above operations with respect to each original, all the originals stacked on the sheet supply tray 101 can be read by the image reading unit 116. In a case where originals having a constant thickness are stacked on the sheet supply tray 101 and the images of the originals are read by the image reading unit 116, the inter-shaft distance between the feed roller 201 and the retard roller 202 may not be adjusted with respect to each original, but may be set to a fixed distance to separate and feed the originals.

On the other hand, when the control unit determines that the originals are being double-fed based on the detection signal from the double feed detection sensor 107, the control unit controls the relevant driving source(s) of the respective rollers 201 and 202 to temporarily stop the separating and feeding operation of originals by the feed roller 201 and the retard roller 202.

At this time, the double-fed overlapping originals are stopped on the conveying pass, and the original(s) fed to the conveying pass in advance of double-fed originals is (are) discharged to the discharge tray 119 via the convey roller pair 117 and the discharge roller pair 118 after reading the images by the image reading unit 116 in the same manner as described above.

Figure 6:
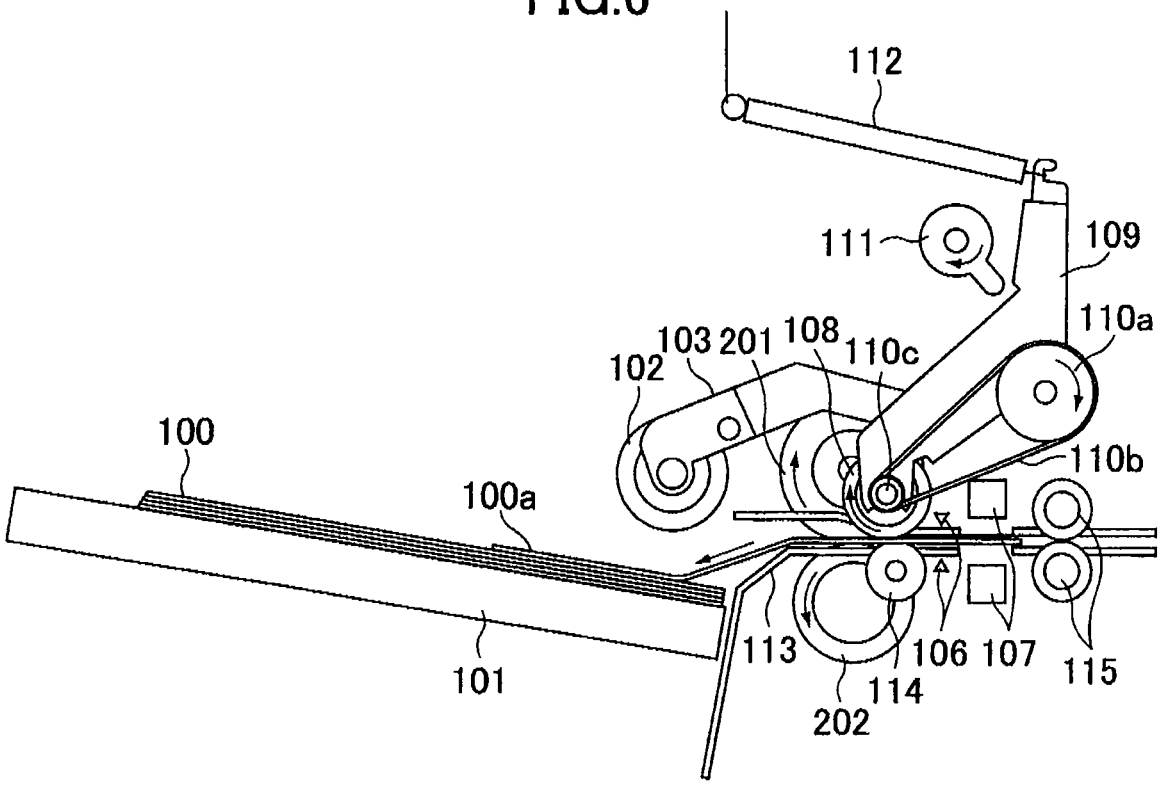
FIG. 6 is a sectional view for explaining a sheet feeding apparatus according to a second embodiment of the present invention.

Subsequently, the control unit controls the rotational position of the rotating lever 111 such that the cam engagement between the rotating lever 111 and the arm 109 is released as shown in FIG. 6. The arm 109 thereby swings in the counter-clockwise direction in FIG. 6 due to the tension of the tension coil spring 112, so that the pullback roller 108 contacts and presses the double-fed overlapping originals with a certain pressing force with the double-fed originals being held between the pullback roller 108 and the pullback idler roller 114. At this time, the feed roller 201 and the retard roller 202 maintain the inter-shaft distance at the time of separating and feeding the originals.

The control unit controls relevant driving source(s) of the pullback roller 108, the feed roller 201 and the retard roller 202 to rotate the respective rollers 108, 201 and 202 in the direction opposite to the feeding direction such that the double-fed overlapping originals are pulled back toward the sheet supply tray 101. Also, the control unit controls relevant driving source of the pickup roller 102 to retract the pickup roller 102, which stops the operation of feeding the originals, to the position where the pickup roller 102 does not contact the originals stacked on the sheet supply tray 101.

After passing through the double feed detection sensor 107 or the registration sensor 106, the double-fed overlapping originals are conveyed reversely during a predetermined time period or a predetermined rotation amount of a drive motor of the pullback roller 108 toward the sheet supply tray 101, and are stopped, for example.

As described above, in the present embodiment, since the double-fed overlapping originals cannot be pulled back to the sheet supply tray 101 side only by the conveying force in the direction opposite to the feeding direction generated by the feed roller 201 and the retard roller 202, the pullback roller 108 supplements additional force to the insufficient reverse conveying force. Accordingly, when the double feed of originals occurs, the double-fed overlapping originals can be reliably pulled back to the sheet supply tray 101 side, so as to retry performing the sheet feeding again.

At the time of pulling back the double-fed overlapping originals to the sheet supply tray 101 side, the inter-shaft distance between the feed roller 201 and the retard roller 202 may be adjusted to a distance at which an appropriate conveying force in the reverse feeding direction can be obtained, to perform the operation of pulling back the of double-fed overlapping originals. Other configurations, operations and advantages are the same as those of the aforementioned first embodiment.

Next, a sheet feeding apparatus according to a third embodiment of the present invention will be described with reference to FIG. 7. Portions overlapping those of the aforementioned first embodiment are assigned the same reference numerals in FIG. 7 to omit the description.

Figure 7:
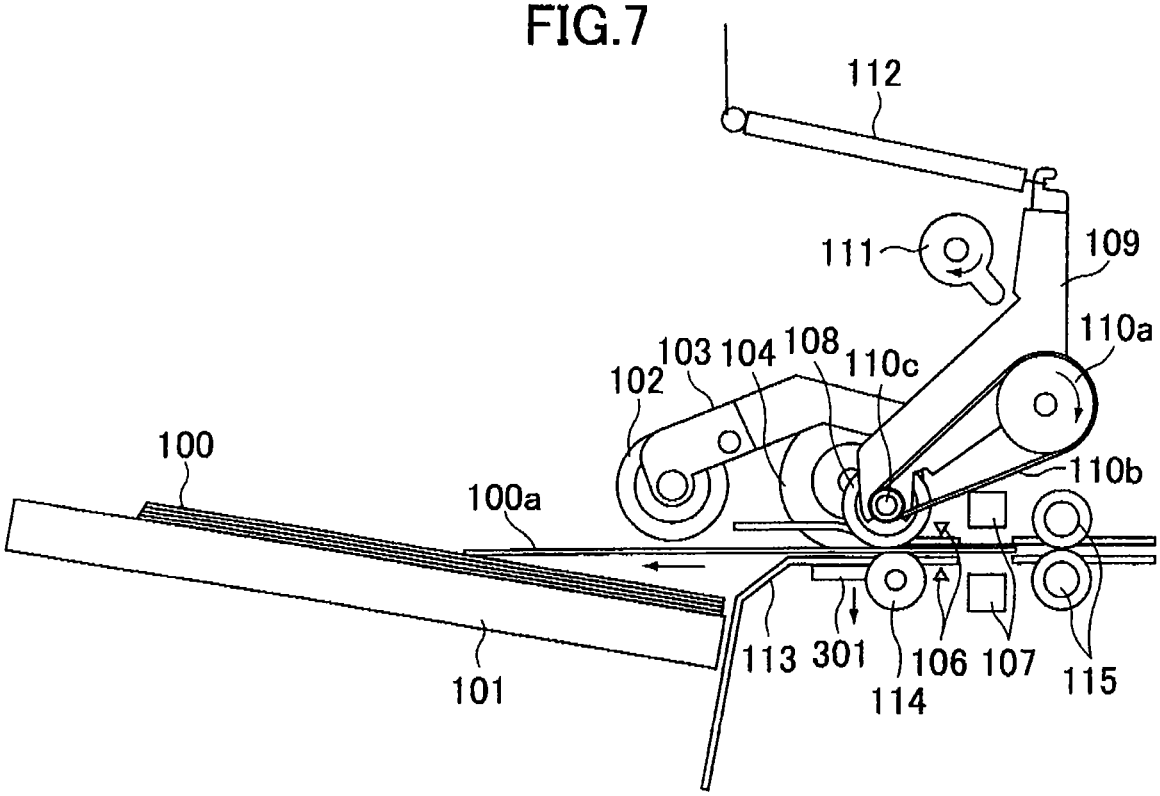
FIG. 7 is a sectional view for explaining a sheet feeding apparatus according to a third embodiment of the present invention.

In the sheet feeding apparatus of the present embodiment, a separation pad 301 as a friction member which separates originals one by one by contacting the feed roller 104 and contacting the originals applying a frictional force generated by contact with the originals as shown in FIG. 7 is used instead of the retard roller 105. The separation pad 301 is supported by a moving mechanism, not shown, so as to be movable to a position where the separation pad 301 can contact the feed roller 104 and a position where the separation pad 301 is separated from the feed roller 104. The control unit controls the moving mechanism to displace the separation pad 301 to the position contacting the feed roller 104 and to the position separated from the feed roller 104 based on the signal of the double feed detection sensor 107.

Also, in the present embodiment, it is preferable that the pullback roller 108 is located at substantially the same position as the contact position between the feed roller 104 and the separation pad 301 with respect to the sheet feeding direction as shown in FIG. 7, or unlike in FIG. 7, the pullback roller 108 is located at the position upstream from the contact position between the feed roller 104 and the separation pad 301 in the sheet feeding direction of the originals.

In the present embodiment, the originals stacked on the sheet supply tray 101 are fed out between the feed roller 104 and the separation pad 301, which are comprised in a separating feeding unit, by the pickup roller 102. When a plurality of originals are fed out by the separating feeding unit, the overlapping originals are separated one by one and fed to the conveying pass by the frictional force of the separation pad 301.

Here, when the control unit determines that the originals fed to the conveying pass are being double-fed based on the detection signal from the double feed detection sensor 107, the control unit controls relevant driving sources of the respective rollers 102 and 104 to temporarily stop the operation of conveying the originals to the separating feeding unit. The double-fed overlapping originals are stopped on the conveying pass, and the original(s) separated and fed in advance of the double-fed originals is (are) discharged to the discharge tray 119 via the convey roller pair 117 and the discharge roller pair 118 after reading the images by the image reading unit 116.

Subsequently, the control unit controls the rotational position of the rotating lever 111 such that the cam engagement between the rotating lever 111 and the arm 109 is released. The arm 109 thereby swings in the counterclockwise direction in FIG. 7 due to the tension of the tension coil spring 112, so that the pullback roller 108 contacts and presses the double-fed overlapping originals with a certain pressing force with the double-fed originals being held between the pullback roller 108 and the pullback idler roller 114.

Also, at the same time, the control unit controls the drive system of the pickup roller 102 to move the pickup roller 102 which stops operating to the position where the pickup roller 102 does not contact the originals stacked on the sheet supply tray 101. Furthermore, the control unit controls the moving mechanism of the separation pad 301 to retract the separation pad 301 to the position separated from the feed roller 104 by retracting the separation pad 301 downward in FIG. 7, so that the separation pad 301 does not apply a load to conveying systems when the originals are pulled back to the sheet supply tray 101 side.

After that, the control unit controls relevant driving sources of the pullback roller 108 and the feed roller 104 to rotate the respective rollers 108 and 104 in the direction opposite to the feeding direction such that the double-fed overlapping originals are pulled back to the sheet supply tray 101 side.

After passing through the double feed detection sensor 107 or the registration sensor 106, the double-fed overlapping originals are conveyed reversely during a predetermined time period or a predetermined rotation amount of a drive motor of the pullback roller 108 to the sheet supply tray 101 side, and are stopped, for example.

As described above, in the present embodiment, the conveying force in the direction to pull back the double-fed overlapping originals can be reliably obtained by using the pullback roller 108 even when the separating feeding unit does not include the retard roller. Other configurations, operations and advantages are the same as those of the aforementioned first embodiment.

Next, a sheet feeding apparatus according to a fourth embodiment of the present invention will be described with reference to FIG. 8. Portions overlapping those of the aforementioned first embodiment are assigned the same reference numerals in FIG. 8 to omit the description.

Figure 8:
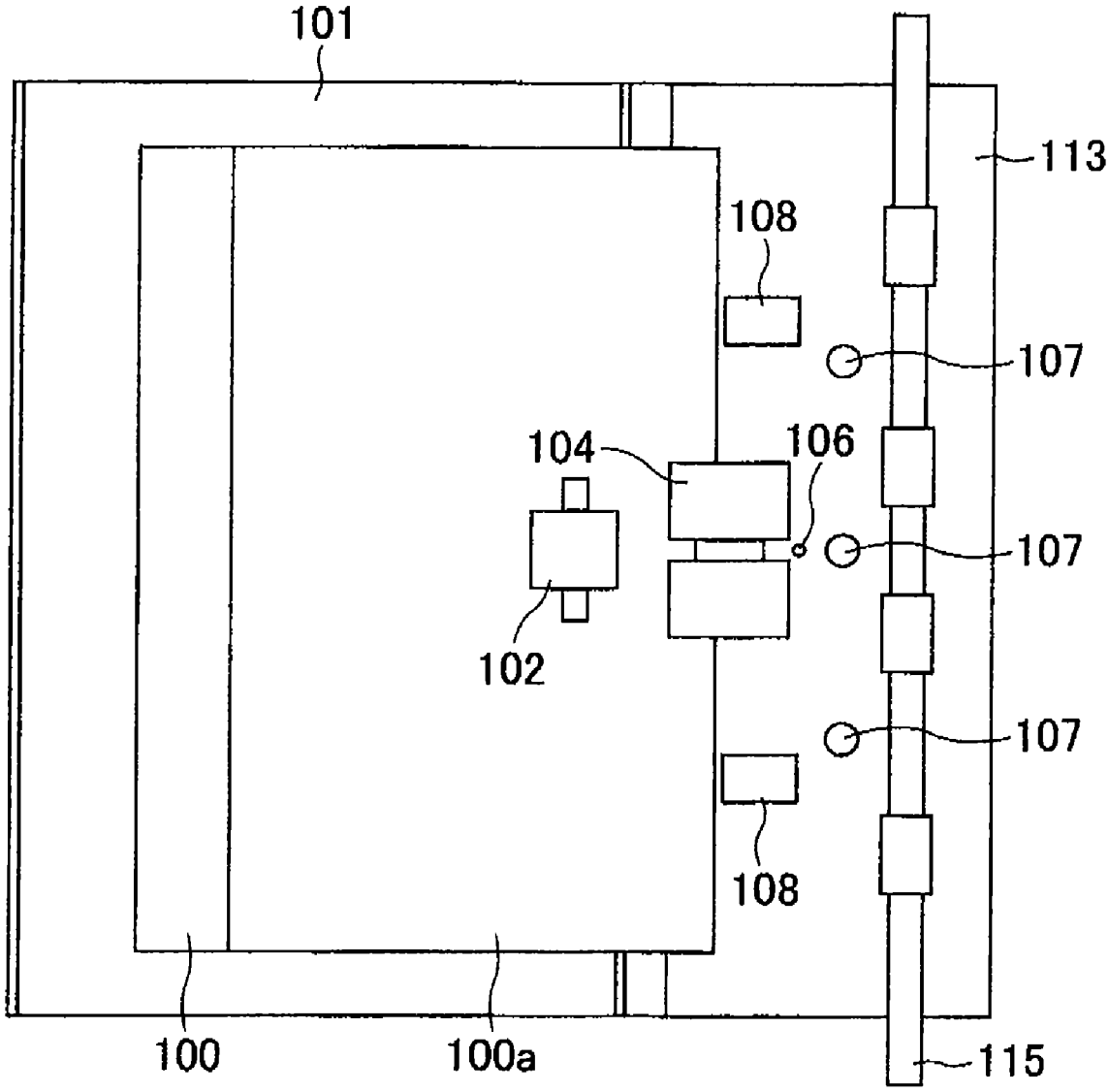
FIG. 8 is a plan view for explaining a sheet feeding apparatus according to a fourth embodiment of the present invention.

The present embodiment shows an example in which a plurality (three in FIG. 8) of double feed detection sensors 107 are disposed at substantially regular intervals in the width direction of the original substantially vertical to the sheet feeding direction as shown in FIG. 8, so that the position for determining the double feed of originals can be selected.

In the present embodiment, in order to reliably pull back the double-fed overlapping originals back to the sheet supply tray 101 side and retry the separating and feeding operation of originals, the pullback roller 108 is disposed at a position adjacent to or a position outside of the arranged position of double feed detection sensors 107 (the outside position in FIG. 8) in the width direction of the original as shown in FIG. 8.

Figure 9:
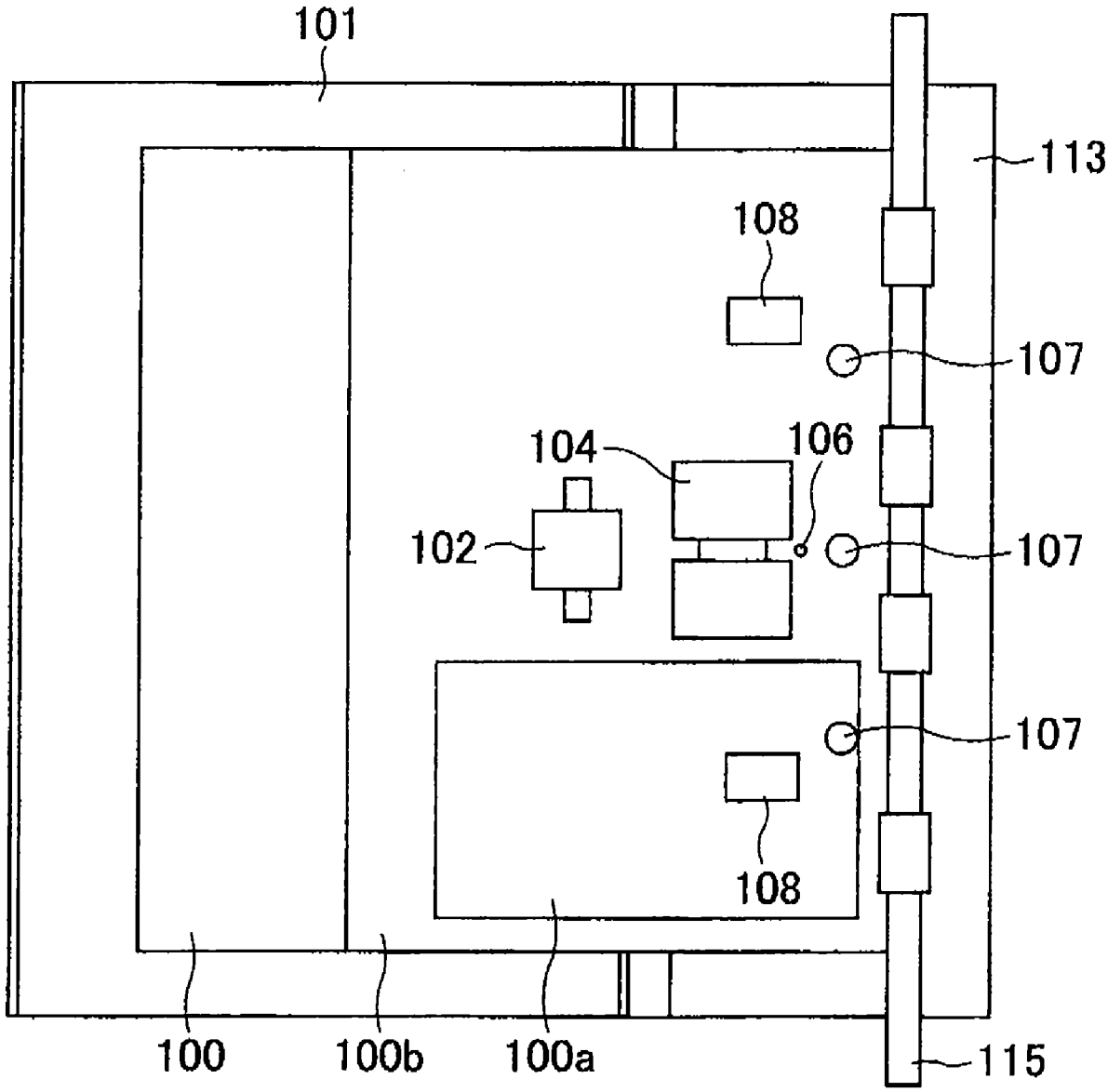
FIG. 9 is a plan view for explaining a state in which a pullback roller contacts an original when originals having different sizes are decentered to one side and double-fed.
Figure 10:
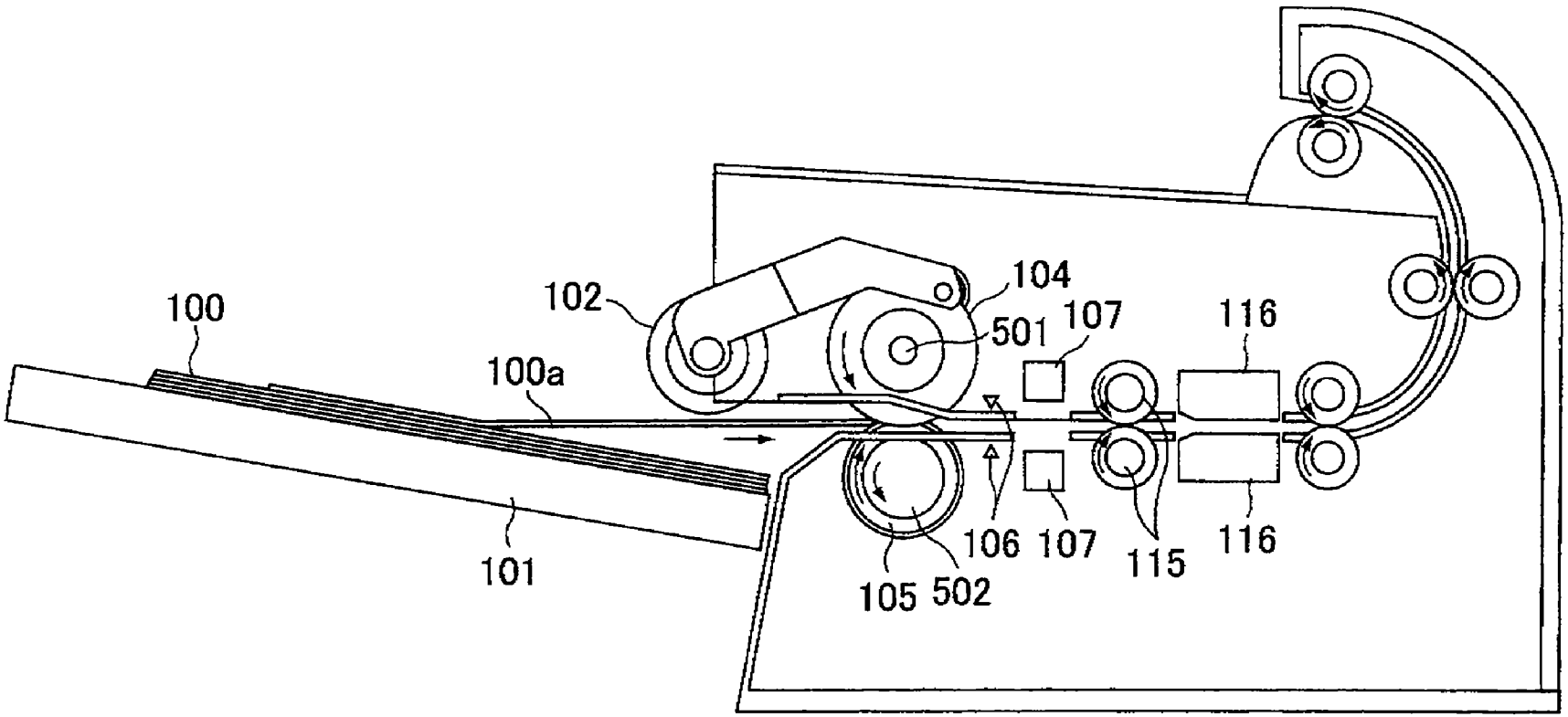
FIG. 10 is a sectional view for explaining a scanner including a conventional sheet feeding apparatus.

Accordingly, even when originals having different sizes are decentered to one side and double-fed, the original can be reliably pulled back to the sheet supply tray 101 side since the pullback roller 108 contacts the original (as the small original 100*a* shown in FIG. 9). Other configurations, operations and advantages are the same as those of the aforementioned first embodiment. In the present embodiment, the case in which the plurality of double feed detection sensors 107 are arranged with respect to the aforementioned first embodiment is described. However, the plurality of double feed detection sensors 107 may also be arranged with respect to the aforementioned second or third embodiment.

The present invention is not limited to the aforementioned embodiments, and may be appropriately changed without departing from the scope of the invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2007-328764 filed Dec. 20, 2007, which is hereby incorporated by reference herein in its entirety.

What is claimed is:

1. A sheet feeding apparatus comprising:

a stacking tray adapted to stack sheets;

a sheet feeding member adapted to feed the sheets incoming from said stacking tray into a conveying pass;

a separating member adapted to be disposed opposite to said sheet feeding member across said conveying pass and separate the sheets fed to said conveying pass by said sheet feeding member one by one;

a double feed detection sensor adapted to generate an output for detecting double feed of sheets fed to said conveying pass;

a rotatable member adapted to be disposed at a position that is substantially the same as or adjacent to said sheet feeding member in a sheet feeding direction and contact the fed sheet;

a driving unit adapted to rotationally drive said rotatable member in a rotational direction for reverse feeding of sheets; and a control unit adapted to control said driving unit such that at least said rotatable member is rotationally driven in said rotational direction for reverse feeding of sheets when the double feed of sheets is detected based on the output of said double feed detection sensor, wherein said rotatable member is disposed so as to be movable to a position contacting the sheet fed to said conveying pass and a position separated from the sheet.

2. The sheet feeding apparatus according to claim 1, and comprising a plurality of said rotatable members, wherein at least a pair of said rotatable members is disposed at substantially symmetrical positions on both sides of said sheet feeding member in a sheet width direction substantially vertical to the sheet feeding direction.

3. The sheet feeding apparatus according to claim 1, and comprising a plurality of said double feed detection sensors disposed in a sheet width direction substantially vertical to the sheet feeding direction, wherein said control unit controls a moving mechanism of said rotatable member such that said rotatable member contacts the sheet when the double feed of sheets is detected based on any one output or any outputs of the outputs of said double feed detection sensors.

4. The sheet feeding apparatus according to claim 1, wherein said sheet feeding member is a roller rotationally driven to feed the sheets, said separating member is a friction member that can contact the sheet, and is disposed so as to be movable to a position contacting said sheet feeding member and a position separated from the sheet, and when the double feed of sheets is detected based on the output of said double feed detection sensor said control unit controls a driving source for moving said separating member such that said separating member is separated from the sheet, and controls a driving source of said sheet feeding member such that said sheet feeding member is rotationally driven in said rotational direction for reverse feeding of sheets.

5. The sheet feeding apparatus according to claim 1, wherein said rotatable member is located upstream from said double feed detection sensor in the sheet feeding direction.

6. A sheet feeding apparatus comprising:

a stacking tray adapted to stack sheets;

a sheet feeding member adapted to feed the sheets incoming from said stacking tray into a conveying pass;

a separating member adapted to be disposed opposite to said sheet feeding member across said conveying pass and separate the sheets fed to said conveying pass by said sheet feeding member one by one;

a double feed detection sensor adapted to generate an output for detecting double feed of sheets fed to said conveying pass;

a rotatable member adapted to be disposed at a position that is substantially the same as or adjacent to said sheet feeding member in a sheet feeding direction and contact the fed sheet;

a driving unit adapted to rotationally drive said rotatable member in a rotational direction for reverse feeding of sheets; and a control unit adapted to control said driving unit such that at least said rotatable member is rotationally driven in said rotational direction for reverse feeding of sheets when the double feed of sheets is detected based on the output of said double feed detection sensor, wherein said sheet feeding member is a roller rotationally driven to feed the sheets, and said separating member is a roller rotationally driven in a separating direction opposite to the sheet feeding direction.

7. The sheet feeding apparatus according to claim 6, wherein when the double feed of sheets is detected based on the output of said double feed detection sensor, said control unit controls relevant driving source(s) of said sheet feeding member and said separating member such that said sheet feeding member is rotationally driven in a rotational direction for reverse feeding of sheets, and such that said separating member is rotationally driven in said separating direction.

8. The sheet feeding apparatus according to claim 6, wherein said sheet feeding member and said separating member are formed with comb-tooth-like shape grooves on outer peripheral portions thereof, and are disposed such that concave portions and convex portions of said sheet feeding member are facing respectively toward convex portions and concave portions of said separating member, and said sheet feeding member and said separating member are in non-contact with each other and overlap each other in perspective view of axial direction thereof.

* * * * *